US009486035B2

(12) United States Patent
Schindler et al.

(10) Patent No.: US 9,486,035 B2
(45) **Date of Patent: *Nov. 8, 2016**

(54) ARTICLE OF FOOTWEAR WITH MULTI-LAYERED SUPPORT ASSEMBLY

(71) Applicant: NIKE, Inc., Beaverton, OR (US)

(72) Inventors: Eric S. Schindler, Beaverton, OR (US); Fred G. Fagergren, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 300 days.

This patent is subject to a terminal disclaimer.

(21) Appl. No.: 14/267,074

(22) Filed: May 1, 2014

(65) Prior Publication Data

US 2014/0230282 A1 Aug. 21, 2014

Related U.S. Application Data

(60) Continuation of application No. 14/012,109, filed on Aug. 28, 2013, now Pat. No. 8,756,832, which is a continuation of application No. 13/295,459, filed on Nov. 14, 2011, now Pat. No. 8,522,454, which is a continuation of application No. 12/767,326, filed on Apr. 26, 2010, now Pat. No. 8,056,263, which is a division of application No. 11/419,379, filed on May 19, 2006, now Pat. No. 7,707,743.

(51) Int. Cl.

| | |
|---|---|
| ***A43B 13/12*** | (2006.01) |
| ***A43B 13/18*** | (2006.01) |
| ***A43B 3/00*** | (2006.01) |

(Continued)

(52) U.S. Cl.

CPC ..... *A43B 13/181* (2013.01); *A43B 1/0009* (2013.01); *A43B 3/0057* (2013.01); *A43B 13/12* (2013.01); *A43B 13/127* (2013.01); *A43B 13/14* (2013.01); *A43B 13/186* (2013.01); *A43B 21/26* (2013.01)

(58) Field of Classification Search

CPC .... A43B 3/0057; A43B 13/00; A43B 13/14; A43B 13/12; A43B 13/125; A43B 13/127

USPC ..... 36/27, 28, 37, 35 R, 25 R

See application file for complete search history.

(56) References Cited

U.S. PATENT DOCUMENTS

| | | | |
|---|---|---|---|
| 4,297,796 | A | 11/1981 | Stirtz et al. |
| 4,535,553 | A | 8/1985 | Derderian et al. |

(Continued)

FOREIGN PATENT DOCUMENTS

| | | | |
|---|---|---|---|
| WO | 9922160 | A1 | 5/1999 |
| WO | 0170064 | A2 | 9/2001 |

(Continued)

OTHER PUBLICATIONS

Office Action issued in corresponding U.S. Appl. No. 14/012,109 dated Oct. 10, 2013.

(Continued)

*Primary Examiner* — Marie Bays

(74) *Attorney, Agent, or Firm* — Banner & Witcoff, Ltd.

(57) ABSTRACT

An article of footwear including an upper and a sole assembly secured to the upper and including a support assembly having an upper member and a lower member spaced from the upper member. A first layer is positioned beneath and in contact with the upper member and has a wave shaped profile with a plurality of first wave crests and first wave troughs. A second layer is positioned above the lower member and has a wave shaped profile with a plurality of second wave crests and second wave troughs.

12 Claims, 7 Drawing Sheets

(51) Int. Cl.

| | |
|---|---|
| ***A43B 1/00*** | (2006.01) |
| ***A43B 21/26*** | (2006.01) |
| ***A43B 13/14*** | (2006.01) |

(56) References Cited

U.S. PATENT DOCUMENTS

| | | | | |
|---|---|---|---|---|
| 4,536,974 | A | 8/1985 | Cohen | |
| 4,611,412 | A | 9/1986 | Cohen | |
| 4,774,774 | A | 10/1988 | Allen, Jr. | |
| 4,798,010 | A * | 1/1989 | Sugiyama | A43B 13/12 36/28 |
| 4,999,931 | A | 3/1991 | Vermeulen | |
| 5,086,574 | A | 2/1992 | Bacchiocchi | |
| 5,224,277 | A | 7/1993 | Sang Do | |
| 5,337,492 | A | 8/1994 | Anderie et al. | |
| 5,353,526 | A | 10/1994 | Foley et al. | |
| 5,575,088 | A | 11/1996 | Allen et al. | |
| 5,606,807 | A | 3/1997 | Prepodnik | |
| 5,799,415 | A | 9/1998 | Kenji et al. | |
| 5,822,886 | A | 10/1998 | Luthi et al. | |
| 5,979,078 | A | 11/1999 | McLaughlin | |
| 6,029,962 | A | 2/2000 | Shorten et al. | |
| 6,205,681 | B1 | 3/2001 | Kita | |
| 6,219,939 | B1 | 4/2001 | Kita et al. | |
| 6,219,940 | B1 | 4/2001 | Kita | |
| 6,289,608 | B1 | 9/2001 | Kita et al. | |
| 6,295,741 | B1 | 10/2001 | Kita | |
| 6,311,414 | B1 | 11/2001 | Kita | |
| 6,314,664 | B1 | 11/2001 | Kita et al. | |
| 6,389,713 | B1 | 5/2002 | Kita | |
| 6,393,732 | B1 | 5/2002 | Kita | |
| 6,401,365 | B2 | 6/2002 | Kita et al. | |
| 6,625,905 | B2 | 9/2003 | Kita | |
| 6,647,645 | B2 | 11/2003 | Kita | |
| 6,711,834 | B1 | 3/2004 | Kita | |
| 6,777,062 | B2 | 8/2004 | Skaja | |
| 6,807,752 | B2 | 10/2004 | Nakano et al. | |
| 6,826,852 | B2 | 12/2004 | Fusco | |
| 7,159,338 | B2 | 1/2007 | LeVert et al. | |
| 7,162,815 | B2 | 1/2007 | Miyauchi et al. | |
| 7,707,743 | B2 | 5/2010 | Schindler et al. | |
| 8,056,263 | B2 | 11/2011 | Schindler et al. | |
| 8,522,454 | B2 | 9/2013 | Schindler et al. | |
| 2001/0049888 | A1 | 12/2001 | Krafsur et al. | |
| 2003/0101621 | A1 | 6/2003 | Nishiwaki et al. | |
| 2004/0154189 | A1 | 8/2004 | Wang | |
| 2005/0028403 | A1 | 2/2005 | Swigart et al. | |
| 2009/0211114 | A1 | 8/2009 | Ivester et al. | |

FOREIGN PATENT DOCUMENTS

| | | | |
|---|---|---|---|
| WO | 03075699 | A1 | 9/2003 |
| WO | 2006032014 | A2 | 3/2006 |
| WO | 2007051538 | A1 | 5/2007 |

OTHER PUBLICATIONS

Office Action issued in corresponding U.S. Appl. No. 14/012,109 dated Jan. 23, 2014.

International Search Report issued in corresponding International Application No. PCT/US2007/067990 issued Nov. 5, 2007.

Office Action issued in corresponding European Patent Application No. 07761721.5 dated Mar. 14, 2011.

Office Action issued in corresponding Chinese Patent Application No. 200780018150.3 dated Aug. 2, 2010.

Office Action issued in corresponding European Patent Application No. 07761721.5 dated Nov. 30, 2012.

European Search Report issued in corresponding EP Application No. 13160341.7 dated Oct. 8, 2013.

* cited by examiner

ARTICLE OF FOOTWEAR WITH MULTI-LAYERED SUPPORT ASSEMBLY

RELATED APPLICATIONS

This application is a continuation of application Ser. No. 14/012,109, filed on Aug. 28, 2013, which is a continuation of application Ser. No. 13/295,459, filed on Nov. 14, 2011, now U.S. Pat. No. 8,522,454, issued Sep. 3, 2013, which is a continuation of application Ser. No. 12/767,326, filed on Apr. 26, 2010, now U.S. Pat. No. 8,056,263, issued Nov. 15, 2011, which is a divisional of application Ser. No. 11/419,379, filed May 19, 2006, now U.S. Pat. No. 7,707,743, issued on May 4, 2010, each of which is entirely incorporated herein by reference.

FIELD OF THE INVENTION

This invention relates generally to an article of footwear, and, in particular, to an article of footwear having a midsole with a multi-layered support assembly.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide fraction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that may include a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane, which compress resiliently under an applied load to attenuate ground reaction forces created by the impacts of running and jumping. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities. The compression of the foam is affected by hysteresis loss, and deflection of such systems is affected by the volume of the compressed mass of the midsole.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear having a midsole with a multi-layered support assembly. In accordance with a first aspect, an article of footwear including an upper and a sole assembly secured to the upper and including a support assembly having an upper member and a lower member spaced from the upper member. A first layer is positioned beneath and in contact with the upper member and has a wave shaped profile with a plurality of first wave crests and first wave troughs. A second layer is positioned above the lower member and has a wave shaped profile with a plurality of second wave crests and second wave troughs.

In accordance with another aspect, an article of footwear includes an upper and a sole assembly secured to the upper. A support assembly has an upper member, a lower member spaced from the upper member, and a first layer positioned beneath and in contact with the upper member and including a plurality of bowls. A second layer is positioned above the lower member and includes a plurality of domes. A third layer is positioned between the first layer and the second layer and has a wave shaped profile extending in a first direction and in a second direction that is substantially perpendicular to the first direction to define a plurality of peaks and valleys, each peak being secured to a bowl and each valley being secured to a dome.

In accordance with a further aspect, an article of footwear includes an upper and a sole assembly secured to the upper. A support assembly includes an upper member and a lower member spaced from the upper member. A first layer is positioned beneath and is in contact with the upper member and includes a plurality of wave troughs extending circumferentially about the support assembly to define a first plurality of concentric grooves. A second layer is positioned above the lower member and includes a plurality of wave crests extending circumferentially about the support assembly to define a first plurality of concentric ribs. A third layer has a plurality of wave crests extending circumferentially about the support assembly to define a second plurality of concentric ribs, and a plurality of wave troughs extending circumferentially about the support assembly to define a second plurality of concentric grooves.

In accordance with yet a further aspect, an article of footwear includes an upper and a sole assembly secured to the upper. A support assembly includes an upper member and a lower member spaced from the upper member. A first layer is positioned beneath and is in contact with the upper member and has a cross-section in a first direction comprising a plurality of wave segments. A second layer is positioned above and is in contact with the lower member and has a cross-section in the first direction comprising a plurality of wave segments.

Substantial advantage is achieved by providing an article of footwear having a midsole with a multi-layered support assembly. In particular, certain embodiments of such an article of footwear allow the support in different portions of the footwear to be configured in different ways. This is highly advantageous since the footwear can be altered in different areas to increase stability and/or optimized for performance.

These and additional features and advantages disclosed here will be further understood from the following detailed disclosure of certain embodiments.

Figure 1:
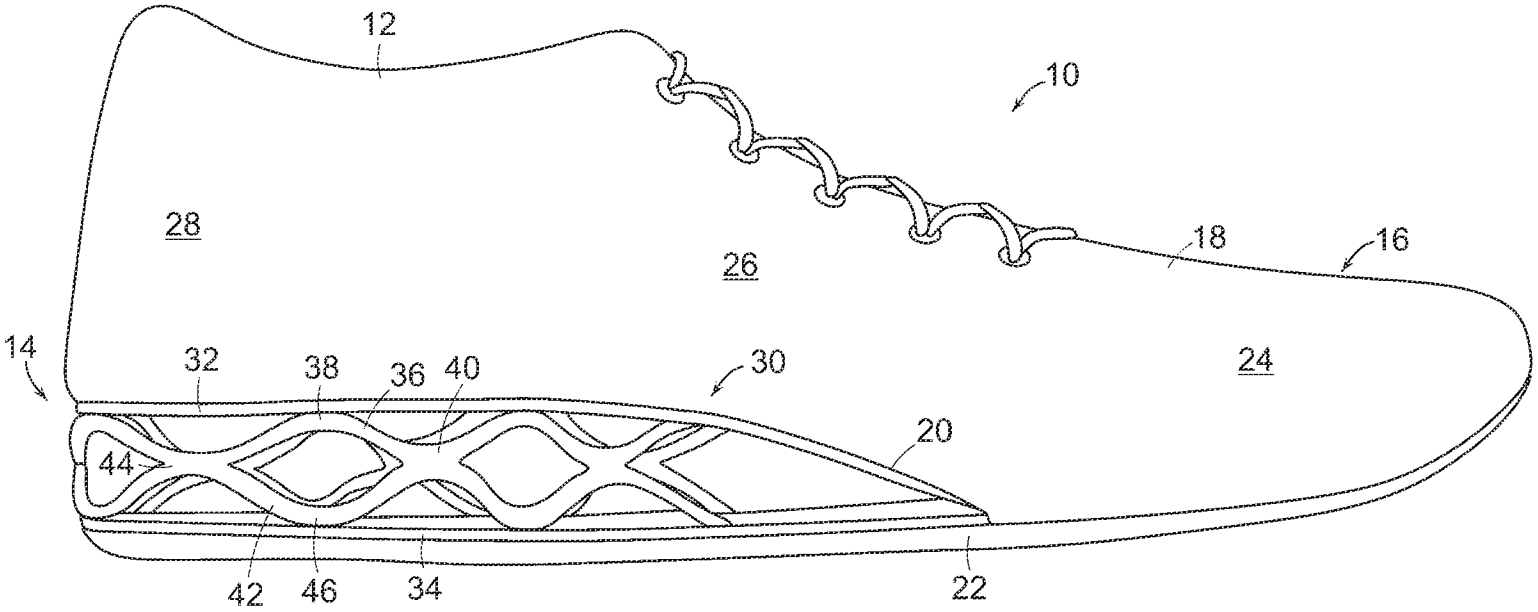
FIG. 1 is an elevation view of an embodiment of article of footwear having a sole assembly with a multi-layered support assembly positioned therein.

The figures referred to above are not drawn necessarily to scale and should be understood to provide a representation of the invention, illustrative of the principles involved. Some features of the article of footwear having a midsole with a multi-layered support assembly depicted in the drawings have been enlarged or distorted relative to others to facilitate explanation and understanding. The same reference numbers are used in the drawings for similar or identical components and features shown in various alternative embodiments. Articles of footwear having a midsole with a multi-layered support assembly as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Sole assembly 14 may be secured to upper 12 by adhesive or any other suitable means. Footwear 10 has a medial, or inner, side 16 and a lateral, or outer, side 18.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole (not shown) located within upper 12, a midsole 20, and an outsole 22.

Upper 12 forms an interior void that comfortably receives a foot and secures the position of the foot relative to sole assembly 14. The configuration of upper 12, as depicted, is suitable for use during athletic activities, e.g., running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Midsole 20 is attached to upper 12 and functions as the primary shock-attenuating and energy-absorbing component of footwear 10. Midsole 20 may be secured to upper 12 by adhesive or other suitable means. Outsole 22 is attached to the lower surface of midsole 20 by adhesive or other suitable means. Suitable materials for outsole 22 include traditional rubber materials. Other suitable materials for outsole 22 will become readily apparent to those skilled in the art, given the benefit of this disclosure. In certain embodiments, sole assembly 14 may not include an outsole layer separate from midsole 20 but, rather, the outsole may comprise a bottom surface of midsole 20 that provides the external traction surface of sole assembly 14.

For purposes of general reference, as illustrated here, footwear 10 may be divided into three general portions: a forefoot portion 24, a midfoot portion 26, and a heel portion 28. Portions 24, 26, and 28 are not intended to demarcate precise areas of footwear 10. Rather, portions 24, 26, and 28 are intended to represent general areas of footwear 10 that provide a frame of reference during the following discussion.

Unless otherwise stated, or otherwise clear from the context below, directional terms used herein, such as rearwardly, forwardly, top, bottom, inwardly, downwardly, upwardly, interior, exterior, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 28, that is, to the left as seen in FIG. 1. Naturally, forwardly is toward forefoot portion 24, that is, to the right as seen in FIG. 1, and downwardly is toward the bottom of the page as seen in FIG. 1. Top refers to elements toward the top of the page as seen in FIG. 1, while bottom refers to elements toward the bottom of the page as seen in FIG. 1. Inwardly or interior is toward the center of footwear 10, and outwardly or exterior is toward the outer peripheral edge of footwear 10.

Sole assembly 14 includes a support assembly 30, formed as a part of midsole 20. As seen here, support assembly 30 extends from a front of midfoot portion 26 on medial side 16 around the periphery of heel portion 28 to a front of midfoot portion 26 on lateral side 18. It is to be appreciated that support assembly 30 may be positioned at any desired location within sole assembly 14.

Figure 2:
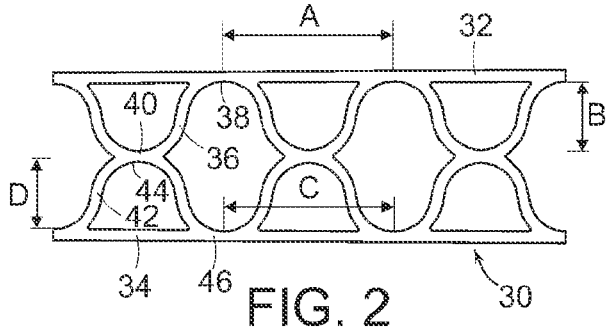
FIG. 2 is an elevation view of the support assembly of the article of footwear of FIG. 1.

Support assembly 30, seen more clearly in FIG. 2, includes an upper plate or member 32, a lower plate or member 34 spaced from upper member 32, and a plurality of layers positioned between upper member 32 and lower member 34. In the embodiment illustrated here, a first layer 36 is positioned directly below, and in contact with, upper member 32. It is to be appreciated that in other embodiments first layer 36 may not be in direct contact with upper member 32 and that another element of footwear 10 may be positioned between first layer 36 and upper member 32, such as a stroebel sock or a foam layer, for example. First layer 36 has a wave-shaped profile, and includes a plurality of first wave crests 38 and first wave troughs 40. First layer 36 has a frequency A, and an amplitude B.

In certain embodiments, upper member 32 and lower member 34 are plates formed of an elastomeric material, e.g., a polyether-block co-polyamide polymer, such as that sold as Pebax® by ATOFINA Chemicals of Philadelphia, Pa., urethane, etc.

A second layer 42 is positioned between, and is in contact with, first layer 36 and lower member 34. It is to be appreciated that in other embodiments second layer 42 may not be in direct contact with lower member 34 and that another element of footwear 10 may be positioned between second layer 42 and lower member 34 such as a foam layer, for example. Second layer 42 also has a wave-shaped profile, and includes a plurality of second wave crests 44 and second wave troughs 46. Second layer 42 has a frequency C and an amplitude D. In certain embodiments, the profiles of first layer 36 and second layer 42 are smooth arcuate waves.

As illustrated here, frequency A of first layer 36 and frequency C of second layer 42 are the same as one another, and amplitude B of first layer 36 and amplitude D of second layer 42 are the same as one another such that each first wave trough 40 is in contact with a corresponding second wave crest 44, and vice versa.

Figure 3:
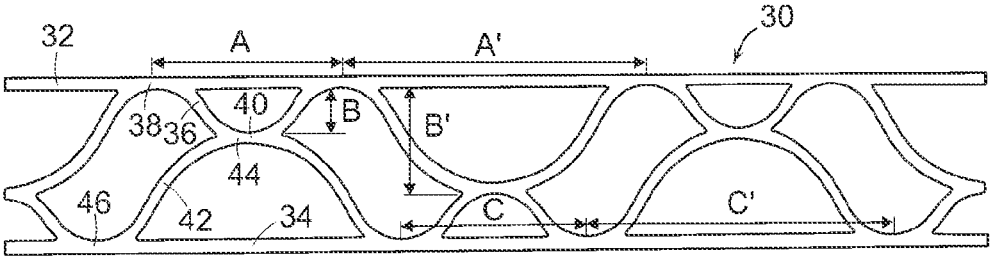
FIG. 3 is an elevation view of an alternative embodiment of the support assembly of the article of footwear of FIG. 1.

It is to be appreciated, however, that the amplitudes and frequencies of first layer 36 need not be the same as those of second layer 42, nor do they need to be the same within any particular layer. For example, as seen in FIG. 3, first layer 36 may have a first frequency A and a second frequency A', along with a first amplitude B and a second amplitude B', with the first and second frequencies and amplitudes alternating along the wave profile. Similarly, second layer 42 may have a first frequency C and a second frequency C', along with a first amplitude D and a second amplitude D' with the first and second frequencies and amplitudes alternating along the wave profile. In this embodiment, each of the second wave crests 44 is in contact with a corresponding first wave trough 40. The performance of footwear 10 can be altered by varying parameters such as the frequency and amplitude. For example, a lower frequency will provide a layer with more compressibility, while a higher frequency will provide the layer with greater stiffness.

First layer 36 and second layer 42 may have any number of amplitudes and frequencies along their length. Additionally, each first wave trough 40 need not necessarily be in contact with a corresponding second wave crest 44.

Figure 4:
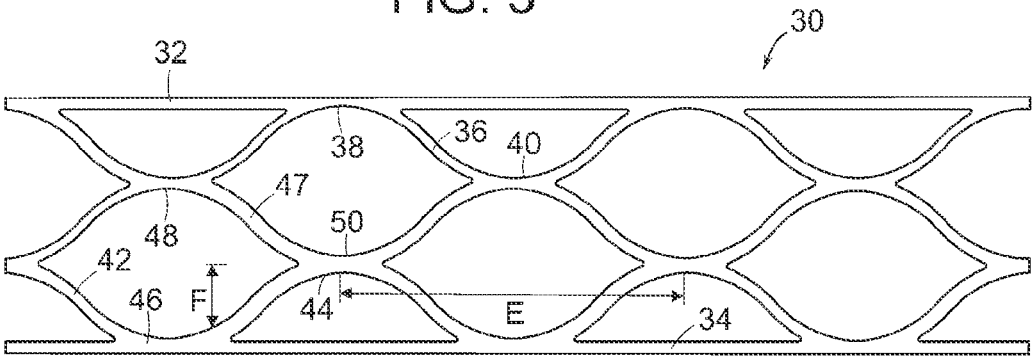
FIG. 4 is an elevation view of a further alternative embodiment of the support assembly of the article of footwear of FIG. 1.

An additional embodiment is shown in FIG. 4, in which a third layer 47 is positioned between first layer 36 and second layer 42. Third layer 47 also has a wave-shaped profile, and includes a plurality of third wave crests 48 and third wave troughs 50. In certain embodiments, the profile of third layer 47 is a smooth arcuate wave. Third wave crests 48 are in contact with first wave troughs, and third wave troughs are in contact with second wave crests 44. First layer 36 has a frequency E, and an amplitude F. As illustrated here, frequencies A, C, and E of first layer 36, second layer 42, and third layer 47, respectively, are equal to one another. Similarly, amplitudes B, D and F of first layer 36, second layer 42, and third layer 47, respectively, are equal to one another. However, as discussed above, it is to be appreciated that the frequencies and amplitudes of each layer can be varied within each layer and with respect to one another.

It is to be appreciated that any number of layers may be used to form support assembly 30, with each particular layer having a desired amplitude and frequency, which may or may not vary along the length of that particular layer, and which may or may not be the same as the amplitude and frequency of the other layers.

Figure 5:
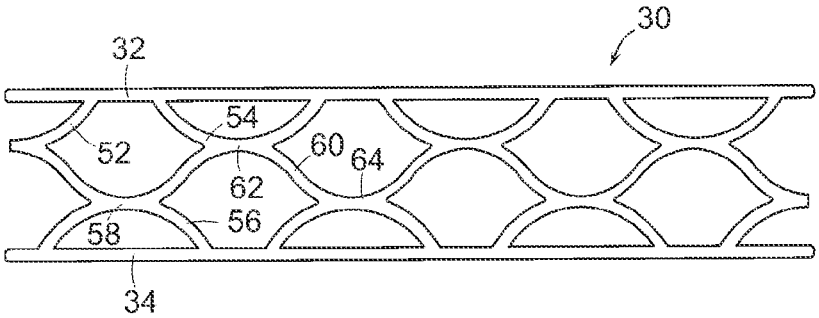
FIG. 5 is an elevation view of yet another alternative embodiment of the support assembly of the article of footwear of FIG. 1.

Certain embodiments may include wave segments rather than complete waves along its profile. For example, in the embodiment shown in FIG. 5, a first layer 52 is positioned below, and in contact with, upper member 32 and is formed of a plurality of first wave troughs 54. A second layer 56 is positioned above, and in contact with, lower member 34 and is formed of a plurality of second wave crests 58. A third layer 60 is positioned between, and in contact with, first layer 52 and second layer 56. Third layer 60 has a wave-shaped profile, and includes a plurality of third wave crests 62 and third wave troughs 64. Third wave crests 62 are in contact with first wave troughs 54. Third wave troughs 64 are in contact with second wave crests 58.

Figure 6:
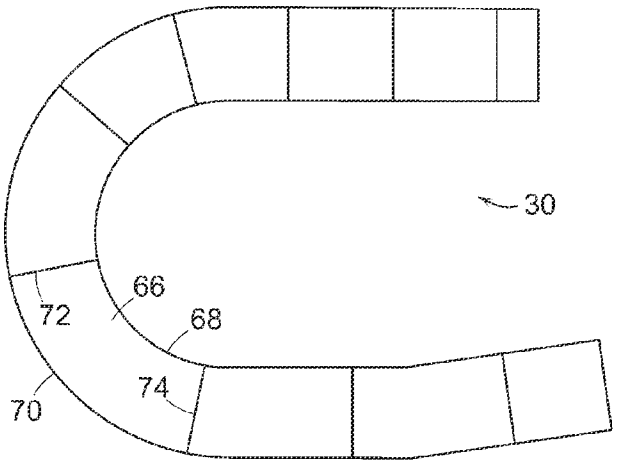
FIG. 6 is a plan view of an alternative embodiment of the support assembly of FIG. 1.
Figure 7:
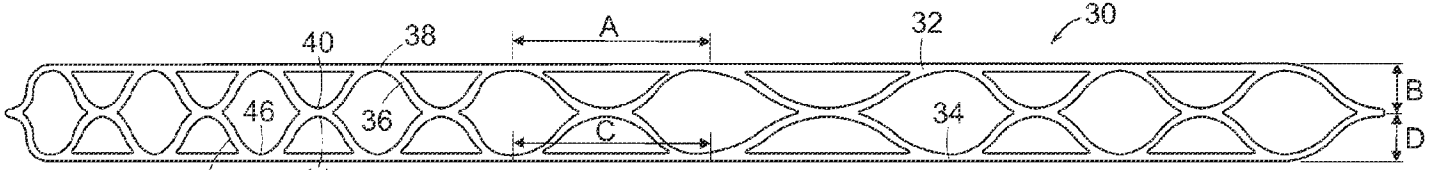
FIG. 7 is an elevation view of the support assembly of FIG. 6.
Figure 8:
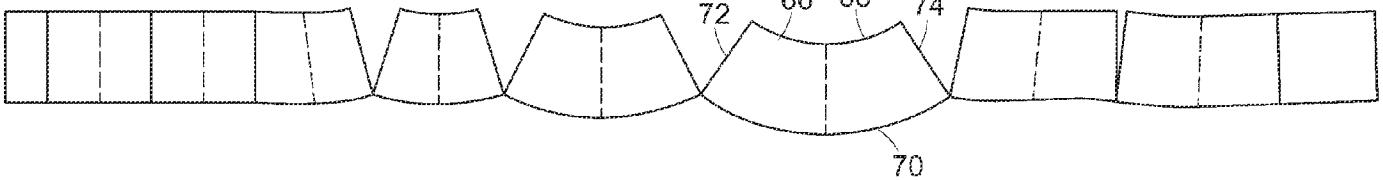
FIG. 8 is a plan view of the support assembly of FIG. 6, shown prior to being formed into its final shape.

Certain embodiments of support assembly 30, as illustrated in FIGS. 6-8, may be formed of a plurality of segments 66. In this embodiment, segments 66 are formed such that support assembly can be wrapped to fit about a perimeter of heel portion 28, as seen in FIG. 1. Each segment 66 has an interior surface 68, an opposed exterior surface 70, a first end surface 72 and an opposed second end surface 74. When the plurality of segments 66 are connected to one another, first and second end surfaces 72, 74 of adjacent segments 66 are naturally in contact with one another.

Interior surface 68 of select segments 66 is concave and exterior surface 70 is convex, as seen in FIGS. 6 and 8, thereby allowing support assembly 30 to be wrapped about and conform to the perimeter of heel portion 28. Additionally, to allow adjacent segments 66 to be properly positioned, first end surface 72 and second end surface 74 of these select segments 66 are configured to extend substantially along the radius of curvature of interior surface 68 and exterior surface 70, as seen best in FIG. 8.

The amplitude B of first layer 36 and amplitude D of second layer 42 are shown in FIG. 7 to be equivalent, however, it is to be appreciated that they may be different from one another. In this embodiment, the frequency A of first layer 36 is not constant, and the frequency C of second layer 42 is not constant. However, the frequency A of each segment 66 along first layer 36 is the same as frequency C of the corresponding segment 66 of second layer 42.

Figure 9:
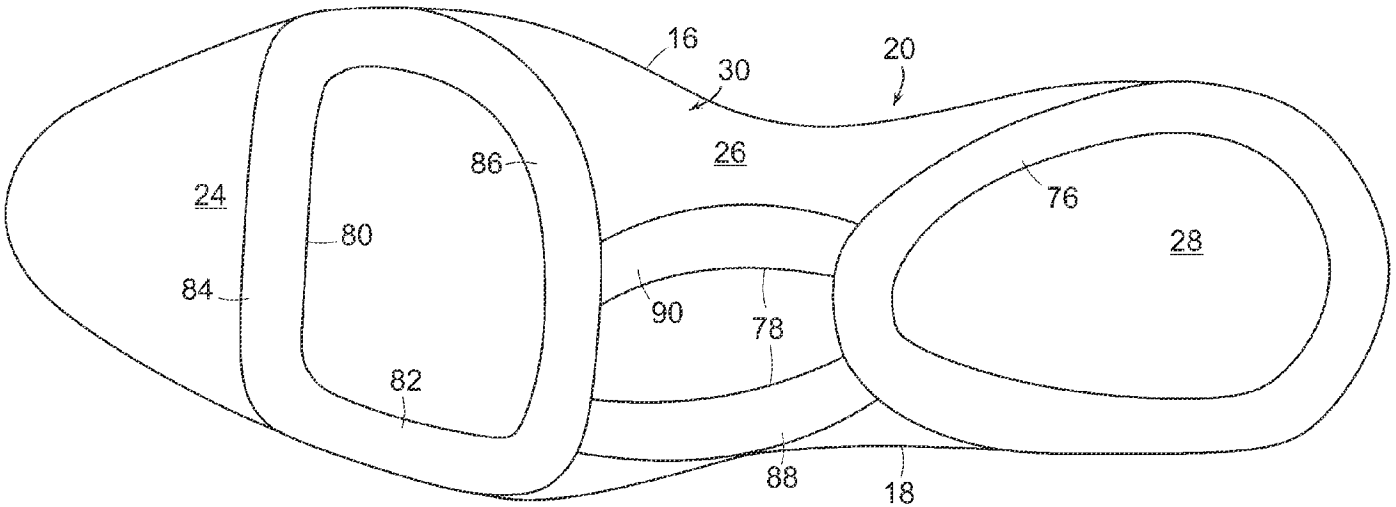
FIG. 9 is a schematic plan view of another alternative embodiment of the support assembly of FIG. 1.

Another embodiment is illustrated in FIG. 9, in which support assembly 30 is formed of a first portion 76 positioned in heel portion 28, a second portion 78 positioned in midfoot portion 26, and a third portion 80 positioned in forefoot portion 24. Each of first portion 76, second portion 78, and third portion 80 has a wave-shaped layered profile, as discussed above. First portion 76 is substantially oval-shaped and extends substantially about a perimeter of heel portion 28. First portion 76 may be formed of segments 66 in the manner discussed above with respect to FIGS. 6-8.

Third portion 80 has a first leg 82 extending along lateral side 18 of forefoot portion 24, a second leg 84 extending from a front end of first leg 82 transversely across forefoot portion 24 to medial side 16 of forefoot portion 24, and a third leg 86 connecting the medial end of second leg 84 to the rear end of first leg 82. In certain embodiments, third leg 86 is arcuate along its length. Third portion 80 may be formed of segments 66 in the manner discussed above with respect to FIGS. 6-8.

Second portion 78 is formed of a first leg 88 extending along lateral side 18 of midfoot portion 26 between first portion 76 and third portion 80. In certain embodiments, first leg 88 is arcuate along its length. A second leg 90 is spaced from first leg 88 in a medial direction and extends between first portion 76 and third portion 80. In certain embodiments, second leg 90 is arcuate along its length. Third portion 80 may be formed of segments 66 in the manner discussed above with respect to FIGS. 6-8.

Thus, it can be seen that support assembly can be positioned in any desired location within footwear 10, and can have any desired shape. Suitable locations and shapes will become readily apparent to those skilled in the art, given the benefit of this disclosure.

Figure 10:
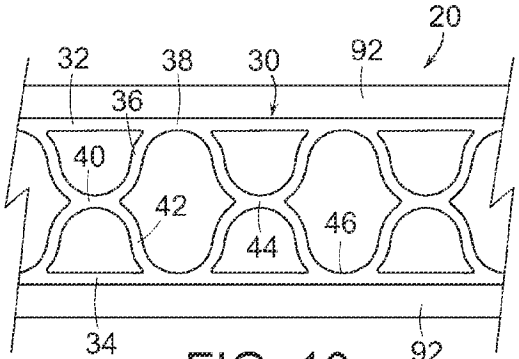
FIG. 10 is an elevation view of an alternative embodiment of the support assembly of the article of footwear of FIG. 1.

Another embodiment is seen in FIG. 10, in which midsole 20 is formed of a layer 92 of foam, with support assembly 30 disposed within layer 92.

The layers of support assembly 30 can be formed in a variety of ways and of various materials, e.g., polymers, such as nylon. For example, support assembly 30 can be formed by injection molding. In such an embodiment, a single material can be injected into a mold and cured, or multiple materials can be injected into a mold, such that the layers of support assembly 30 are of unitary, that is, one-piece construction. In other embodiments, the layers of support assembly 30 can be secured to one another by adhesive. In other embodiments, they layers may be formed of melt-compatible materials and secured to one another via various methods such as laser welding, ultrasonic welding, solvent welding and high frequency welding, for example. In other embodiments, the layers may be secured to one another by mechanical means, e.g., fasteners such as snaps. Other suitable means of securing the layers to one another will become readily apparent to those skilled in the art, given the benefit of this disclosure.

Since each layer can be formed of a different material, and the material within any particular layer can be varied from one part to another, the performance characteristics of support assembly 30 can be tailored by selecting materials with a particular density, modulus of elasticity, or any other parameter to provide a desired performance result.

Figure 11:
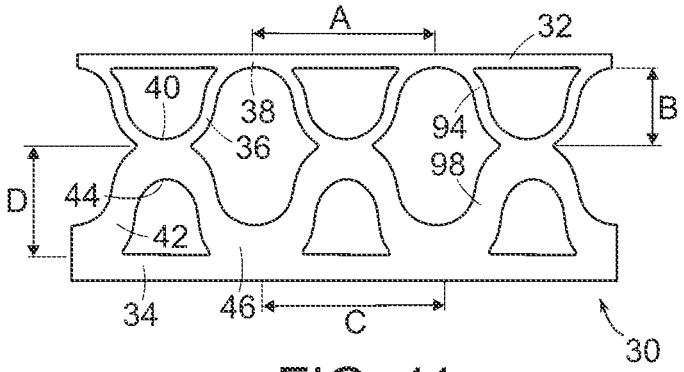
FIG. 11 is an elevation view of another alternative embodiment of the support assembly of the article of footwear of FIG. 1.

The layers of support assembly 30 can also have different thicknesses than one another in order to optimize performance of support assembly 30. Thus, one layer of support assembly 30 can have a first thickness while another layer has a second thickness. In the embodiment illustrated in FIG. 11, for example, first layer 36 has a first thickness 94, while second layer 42 has a second thickness 96. In the illustrated embodiment, second thickness 96 is thicker than first thickness 94. However, It is to be appreciated that second thickness 96 could also be thinner than first thickness 94.

Figure 12:
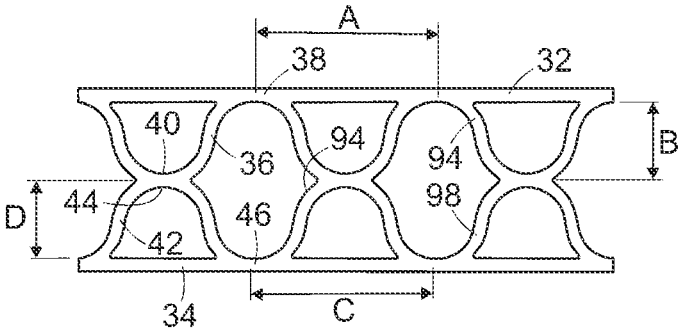
FIG. 12 is an elevation view of yet another alternative embodiment of the support assembly of the article of footwear of FIG. 1.

As illustrated in FIG. 12, first layer 36 has first thickness 94. Second layer 42, on the other hand has a first portion with first thickness 94 and a second portion with a second thickness 98, which is thicker than first thickness 94. It is to be appreciated that second thickness 98 could also be thinner than first thickness 94. Additionally, it is to be appreciated that second layer 42 could have more than two distinct thicknesses along its length, as could any layer of support assembly 30.

Thus, it can be seen that each individual layer of support assembly 30 can have a single, constant thickness along its length, which may or may not be the same thickness of any one or all other layers in support assembly 30. Further, any one or all of the layers of support assembly can have different thicknesses along its length. Thus, it is to be appreciated that any desired combination of thicknesses of the different layers within support assembly is considered to be within the scope of the invention.

Figure 13:
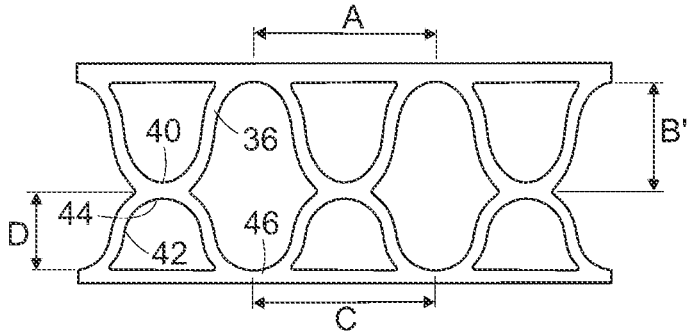
FIG. 13 is an elevation view of a further alternative embodiment of the support assembly of the article of footwear of FIG. 1.

Another embodiment is illustrated in FIG. 13, in which first layer 36 has the same frequency as that of second layer 42, but the amplitude of first layer 36 is greater than that of second layer 42. Specifically, first layer 36 has amplitude B', which is larger than amplitude D of second layer 42. It is to be appreciated that in certain embodiments, amplitude B' could be smaller than amplitude D of second layer 42.

The performance characteristics of support assembly 30 can therefore be tailored to provide desired results throughout footwear 10. By altering the frequency, amplitude, material, number, location and thickness of the layers, for example, the performance characteristics of support assembly 30 can be varied at any desired location within footwear 10. For example, the layers may be configured such that support assembly 30 is stiffer on medial side 16 than on lateral side 18, thereby providing more medial support to resist pronation. Similarly, support assembly could have a first stiffness or support level in heel portion 28, a second level in midfoot portion 26, and a third level in forefoot portion 24, or any combination thereof. By altering any one or any combination of the characteristics of the layer, the performance of footwear 10 can easily be optimized for a particular use or even a particular individual.

Figure 14:
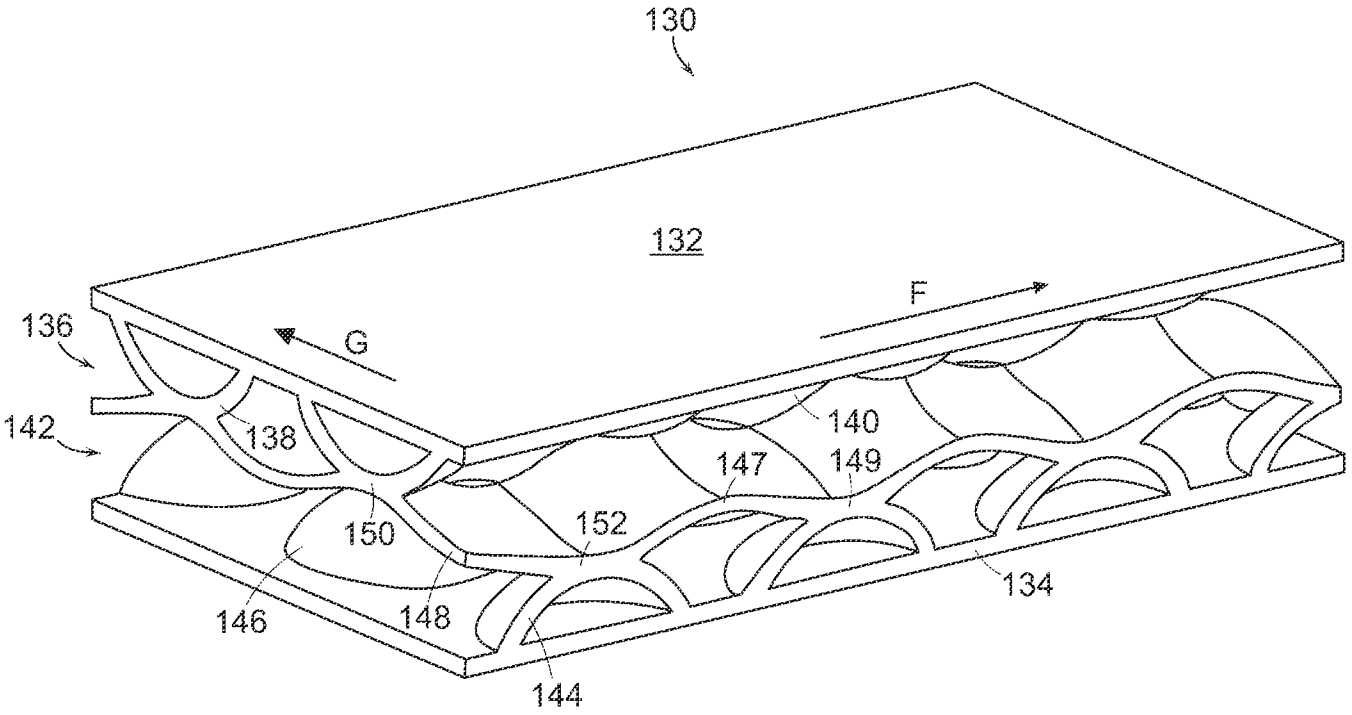
FIG. 14 is a perspective view of an embodiment of the support assembly of FIG. 1, shown with a wave-shaped profile extending in a first direction and in a second direction substantially perpendicular to the first direction.

Another embodiment is shown in FIG. 14, in which a support assembly 130 takes the form of a plate rather than a strip as illustrated in the support assembly 30 seen FIGS. 1 and 6-9. In this embodiment, support assembly 130 has a wave-shaped profile in a first direction F as well as a wave-shaped profile in a second direction G, which is substantially perpendicular to first direction F. In this embodiment, support assembly 130 has a first layer 136 positioned beneath and in contact with an upper member 132 and comprising a plurality of wave segments, namely wave troughs 138, extending in directions F and G, which, when combined, form bowls 140 that are suspended from upper member 132.

A second layer 142 is positioned above and in contact with a lower member 134 and is formed of a plurality of wave segments, namely wave crests 144, extending in directions F and G, which, when combined, form domes 146 that are seated on lower member 134.

A third layer 148 is positioned between first layer 136 and second layer 142, and has a wave-shaped profile in first direction F and second direction G with a plurality of wave crests 147 and wave troughs 149. Thus, in this embodiment, third layer 148 defines a plurality of peaks 150 and valleys 152 in a quilt-like configuration. Peaks 150 are in contact with the bottoms of bowls 140 and valleys 152 are in contact with the tops of domes 146.

It is to be appreciated that first layer 136 and second layer 142 may each have full wave-shaped profiles in first direction F and second direction G, rather than being formed of only wave segments as illustrated here.

Figure 15:
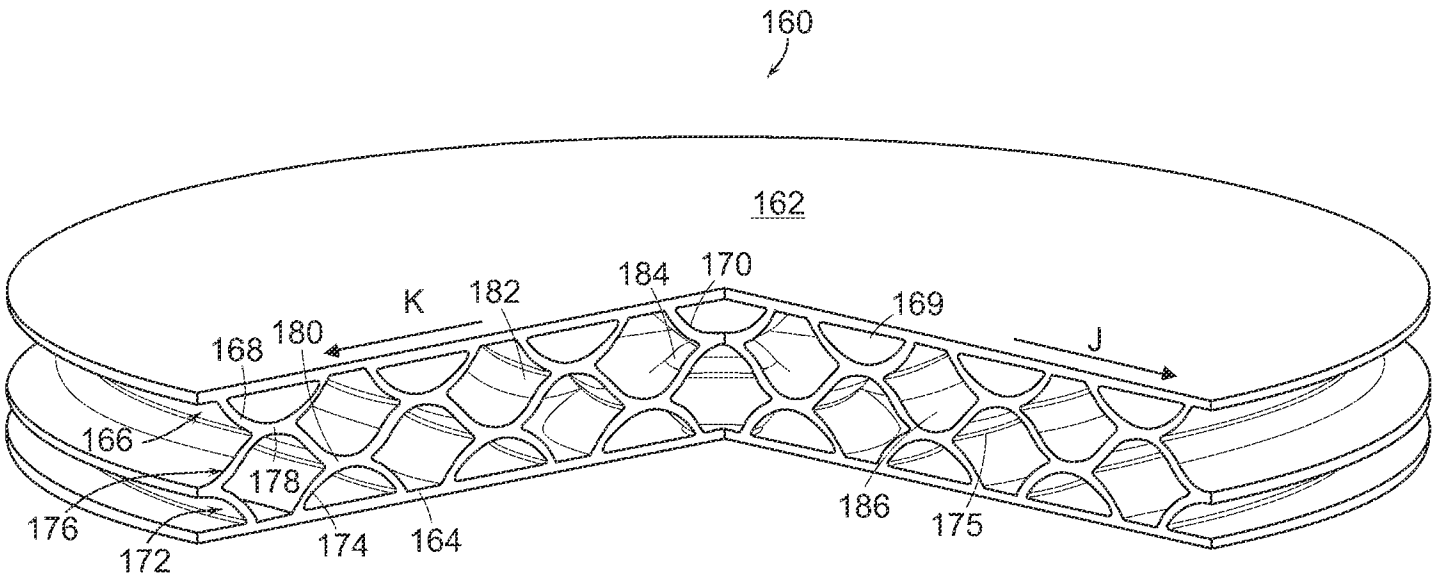
FIG. 15 is a perspective view of another embodiment of the support assembly of FIG. 1, shown partially cut-away, having a circular configuration and a wave-shaped profile extending in a first direction and in a second direction substantially perpendicular to the first direction.

Another embodiment of a support assembly 160 is shown in FIG. 15, partially cut-away for improved visibility. Support assembly 160 has a circular configuration with an upper member 162 and a lower member 164 with a first layer 166 positioned beneath upper member 162. First layer 166 is formed of a plurality of wave segments, namely wave troughs 168 extending along a first direction J and a second direction K extending substantially perpendicular to first direction J, with first direction J and second direction K extending along radii of circular support assembly 160. Wave troughs 168 extend circumferentially about support assembly 160 forming a first plurality of concentric grooves 169. In the illustrated embodiments, the innermost wave troughs 168 along first and second directions J, K form a bowl 170 at the center of support assembly 160.

Similarly, a second layer 172 is positioned above lower member 164 and is formed of a plurality of wave segments or wave crests 174 extending along first direction J and second direction K. Wave crests 174 extend circumferentially about support assembly 160 forming a first plurality of concentric ribs 175. In certain embodiments, the innermost wave crests 174 along first direction J and second direction K may combine to form a dome (not shown) at the center of support assembly 160.

A third layer 176 is positioned between first layer 166 and second layer 172. Third layer 176 has a wave-shaped profile in both first direction J and second direction K, defining a plurality of wave crests 178 and wave troughs 180. Wave crests 178 extend circumferentially about support assembly 160 forming a second plurality of concentric ribs 182. In the illustrated embodiment, the innermost wave crests 178 along first direction J and second direction K combine to form a dome 184 at the center of support assembly 160. Wave troughs 180 extend circumferentially about support assembly 160 forming a second plurality of concentric grooves 186. In certain embodiments, the innermost wave crests 180 along first direction J and second direction K may combine to form a bowl (not shown) at the center of support assembly 160.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper; and a sole assembly secured to the upper and including a support assembly having a plurality of layers, each layer having a smooth arcuate wave profile, a plurality of wave crests, and a plurality of wave troughs;

wherein an amplitude of at least one layer is one of non-constant along its length and different than an amplitude of another layer;

wherein a frequency of at least one layer is one of non-constant along its length and different than a frequency of another layer; and wherein a top of each wave crest in one of the layers positioned beneath another layer is connected to a bottom of one of the wave troughs, and a bottom of each wave trough in one of the layers positioned above another layer is connected to a top of one of the wave crests.

2. The article of footwear of claim 1, wherein the amplitude of each layer is non-constant along its length.

3. The article of footwear of claim 1, wherein the amplitude of each layer is different than the amplitude of another layer.

4. The article of footwear of claim 1, wherein the frequency of each layer is non-constant along its length.

5. The article of footwear of claim 1, wherein the frequency of each layer is different than the frequency of another layer.

6. The article of footwear of claim 1, wherein the support assembly comprises a portion of a midsole.

7. The article of footwear of claim 1, further comprising an outsole secured to the support assembly.

8. The article of footwear of claim 1, wherein the support assembly includes a first layer and a second layer positioned beneath the first layer.

9. The article of footwear of claim 8, further comprising a third layer positioned between the first layer and the second layer.

10. The article of footwear of claim 8, wherein the first layer has a first thickness and the second layer has a second thickness that is different than the first thickness.

11. The article of footwear of claim 1, further comprising a midsole positioned beneath the upper.

12. The article of footwear of claim 11, wherein the sole assembly is disposed within the midsole.

* * * * *